United States Patent [19]

Davis, II

[11] 4,065,927

[45] Jan. 3, 1978

[54] METHOD FOR BLOCKING GAS FLOW IN A COAL SEAM

[75] Inventor: J. Gilbert Davis, II, Morgantown, W. Va.

[73] Assignee: Continental Oil Company, Ponca City, Okla.

[21] Appl. No.: 542,149

[22] Filed: Jan. 20, 1975

[51] Int. Cl.[2] ..... E02D 3/14; E21F 15/00

[52] U.S. Cl. ..... 61/36 R; 299/12

[58] Field of Search ..... 61/35, 36 R; 299/12; 166/308, 281

[56] References Cited

U.S. PATENT DOCUMENTS

| | | | |
|---|---|---|---|
| 3,106,959 | 10/1963 | Huitt et al. | 166/308 |
| 3,211,221 | 10/1965 | Huitt | 166/308 |
| 3,297,088 | 1/1967 | Huitt et al. | 166/281 |
| 3,300,984 | 11/1967 | Armentrout | 61/36 R |
| 3,688,507 | 9/1972 | Muller | 61/36 R |
| 3,845,632 | 11/1974 | Slobod et al. | 61/36 R |

FOREIGN PATENT DOCUMENTS

| | | | |
|---|---|---|---|
| 1,182,190 | 11/1964 | Germany | 299/12 |

*Primary Examiner*—Paul R. Gilliam
*Assistant Examiner*—Alex Grosz
*Attorney, Agent, or Firm*—William J. Miller

[57] ABSTRACT

Gas flow from a coal seam to a mine face in the seam is blocked by drilling a hole from the face into the seam in a direction generally parallel to the direction of the flow of the gas to be blocked; forming a notch at the interior end of the hole; injecting a fluid into the hole and notch under a pressure sufficient to hydraulically fracture the seam along a plane extending substantially perpendicular to the hole and to the direction of gas flow; and filling such fracture with a barrier-forming fluid. The hole is then plugged to prevent retrograde flow of the fluid to the mine face.

14 Claims, 3 Drawing Figures

METHOD FOR BLOCKING GAS FLOW IN A COAL SEAM

BACKGROUND OF THE INVENTION

1. Field of the Invention

This invention relates to the mining of coal, and more particularly, to methods of obstructing or blocking the deleterious flow of methane gas into the mine from the coal seam.

2. Brief Description of the Prior Art

U.S. Pat. No 3,845,632 to Slobod and Burcik describes a method for obstructing or blocking the flow of methane gas from a coal seam into a mine entry formed in the seam by drilling holes into the seam, and injecting a gelable silicic acid composition via these holes into the cracks and fissures which exist naturally in the coal at the cleavage planes thereof. The silicic acid gel which results after such injection forms a blockage in the cracks and fissures existing at the cleavage planes of the coal, and prevents traverse of these cracks and fissures by methane gas so as to enter the mine at a location where these cracks intersect a mine face.

In carrying out the process of attaining blockage of gas flow using a silicic acid gel, the silicic acid composition, when initially infused through the bore holes formed in the seam, must be of low viscosity and quite fluid, so that gelling does not occur prior to the dispersion of the silicic acid into the natural cracks and fissures intersected by the bore holes. Care must also be exercised to make certain that lumps or solid particles do not form in the pre-mixed silicic acid composition which will block free flow into the cracks and fissures, or which will be filtered out by very small cracks located along the hole. It is also necessary, in using the silicic acid method of blocking, to very closely control the time interval over which the composition can set up or gel to a semi-solid state so that it completely fills the cracks and fissures without slumping due to late setting, and so that it does not gel prematurely, thus requiring excessively high pressures or completely arresting the infusion.

In the technology of oil and gas production, it is known to fracture certain subterranean formations to enhance or increase production therefrom by providing a directionally oriented notch in the formation to be fractured, followed by the injection into the notch of a relatively viscous fluid under high pressure so that the natural forces of adhesion in the rock, along with the natural rock stresses, are overcome, and a fracture is propagated from the notch for a substantial distance into the formation. A technique of this general type is disclosed in U.S. Pat. No. 3,106,959.

BRIEF DESCRIPTION OF THE PRESENT INVENTION

The present invention comprises an improved method for obstructing or blocking the flow or migration of gas from the interior of a coal seam to the face of a rib or a working face in a coal mine. Broadly described, the method of the invention entails initially drilling a bore hole from an exposed face along the seam into the seam in a direction which is substantially parallel to the direction of the flow of gas from the interior of this seam to the exposed face. Such direction of flow will, in general, be determined by the orientation of the cleavage planes in the coal.

After formation of the bore holes in the described direction in the coal seam, a notch extending substantially perpendicular to the long axis of the bore hole is formed at the interior end thereof. A fluid is then injected into the bore hole under pressure to hydraulically fracture the coal seam in a direction extending outwardly from the notch, and substantially perpendicular to the long axis of the hole and to the direction of gas flow toward the face of the seam. Finally, the fluid used for forming the fracture, and for filling the fracture and hole is sealed or plugged in place, either by setting up to a solid or a semi-solid state, or by simply plugging the hole to prevent retrograde flow to the mine face. The described steps are then repeated at other locations along the face of the seam to provide an overlapping group of the barriers formed by each barrier fluid-filled fracture.

The method of the invention provides the advantage of obviating the necessity of providing barrier fluid or gel in a sufficiently large quantity to entirely fill the cracks and fissures along the multiple cleavage planes in the seam to completely obstruct the entire flow path of the gas from within the coal to the exposed mine face via these extensive cracks and fissures. The method is further advantageous in that much thicker liquids can be employed for fracturing and blocking the gas flow than where a gelable silicic acid is used, although the latter materials are also operable as barrier fluids in the process of the present invention. Further, the invention enables a gas barrier to be formed by fracturing to form a filled fracture intersecting the gas flow paths along the planes of cleavage, and this is generally a less expensive and more expedient procedure than where infusion holes must be drilled into the coal seam which will project across most of the planes of cleavage and will act as conduits for barrier fluid to be injected into the multiple cracks and fissures generally present at all of the cleavage planes.

Additional objects and advantages of the invention will become apparent as the following detailed description of a preferred embodiment of the invention is read in conjunction with the accompanying drawings which illustrate the invention.

GENERAL DESCRIPTION OF THE DRAWINGS

FIG. 1 is a schematic illustration, in plan, of a coal mine having a bore hole formed in a rib face of the seam for purposes of commencing the method of the present invention. Shown at the end of the bore hole is a lens-shaped notch which has been formed for the purpose of commencing the fracturing of the seam.

FIG. 2 of the drawings is a schematic plan view of the coal seam after development of a fracture propagated outwardly from the lens-shaped notch, and extending substantially normal to the cleavage planes in the seam.

FIG. 3 is a schematic plan view of a completed system of interlocking sealed fractures disposed in the seam for blocking gas flow to the rib face along the mine entry.

DETAILED DESCRIPTION OF A PREFERRED EMBODIMENT OF THE INVENTION

Figure 1:
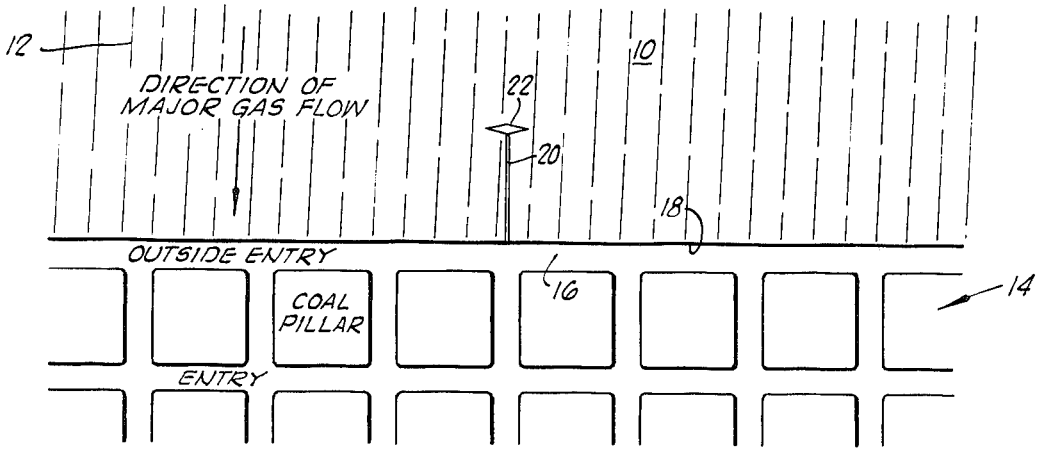

Referring initially to FIG. 1 of the drawings, schematically illustrated therein is a coal seam 10 having characteristic cleavage planes 12 represented by substantially parallel dashed lines. The coal seam 10 is traversed by a mine heading 14 of the typical room and pillar development type. The mine heading 14 includes an outside entry 16 which is bounded by a vertical rib face 18 extending along the coal seam 10.

Most bituminous coal seams are characterized in having substantially parallel bedding and cleavage planes oriented in the manner illustrated. These planes of cleavage 12 are the locus of cracks and fissures of sufficient porosity that methane desorbed from the coal micropores can traverse these cracks and fissures, and be emitted from the seam at the location where the planes of cleavage intersect a rib face or working face of a coal mine heading which has been developed in the seam. Thus, in FIG. 1, the direction of the major gas flow of methane through the coal seam 10 is indicated to be substantially parallel to the planes of cleavage 12, and such gas flow results in the emission of methane at the illustrated rib face 18, and a dangerous buildup of gas in the outside entry 16 of the heading 14.

In commencing the method of the present invention for blocking the flow of methane gas to the rib face 18 adjacent the outside entry illustrated in FIG. 1, a substantially horizontally extending infusion hole 20 is drilled from the rib face into the seam 10 in a direction substantially parallel to the direction of gas flow or, stated differently, generally parallel to the planes of cleavage 12. The distance into the seam 10 which the infusion hole 20 is drilled can very widely, but generally will be from about 30 feet to about 150 feet. With most types of coal seams, the distance employed will be from about 50 feet to about 100 feet. The diameter of the infusion hole 20 which is drilled in the rib face 18 can also vary widely, but is typically from about 1½ inch to about 5 inches. Although the infusion hole 20 is illustrated as being drilled into the seam from a solid rib facing the outside entry 16, the same procedure can be carried out from an active mining face where the direction of gas flow is substantially normal to such mining face.

At the inner end of the infusion hole 20, a notch 22, which is dish-shaped, or has the shape of a double convex lens, is formed, and extends substantially normal to the longitudinal axis of the infusion hole, as well as normal to the direction of flow of gas toward the rib face 18. The lens-shaped notch 22 can be cut with a mechanical device, or can be formed by abrasion of the seam with a liquid-solid slurry pumped through a head perforated by small jets, and positioned at the end of the infusion hole 20. Both techniques are known in the art of oil and gas production. In most instances, the use of a mechanical cutting device is preferable because the very sharp notch which can be formed in this way permits better control and orientation of the fracture subsequently to be developed by propagation from this notch. Jetting with an abrasive slurry may in some instances be more practical, however, because a much smaller infusion hole is required to extend the jetting equipment into position for formation of the notch. The notch 22 preferably has a diameter which is greater than about 10 inches, and, in general, the larger the diameter of the notch, the more effective is the subsequent fracturing step.

It will be noted in referring to FIG. 1 that the infusion hole 20 is illustrated as having been drilled directly opposite the passage which exists between two coal pillars in the room and pillar development. Drilling of the infusion hole 20 at this location constitutes a preferred practice of the invention, since this permits elongated drills to be extended across the outside entry into the space between pillars, and thereby facilitates drilling. The infusion holes 20 which are utilized can, however, be drilled at any location along the rib face 18, provided only that they are extended into the seam 10 in a direction which is substantially parallel to the direction of gas flow therein.

After formation of the infusion hole 20 and the lens-shaped notch 22 at the end thereof, a fracturing fluid is injected into the infusion hole and into the notch. The fracturing fluid employing is preferably a relatively viscous fluid which is not capable of significant entry into the vertical crack system formed along the cleavage planes. Significant diversion of the fracturing fluid into these cracks will result in diversion of the fracture from its intended direction of propagation in a plane normal to the cleavage planes and to the direction of the gas flow, and in undesirable loss of fracturing fluid into the vertical crack system. Obviation of significant loss of the fracturing fluid can be accomplished through the use in the fracturing fluid of known plugging or lost circulation materials, or very high viscosity fluids can also be employed as is well-known and conventional in the art of hydraulic fracturing. Typical lost circulation materials which can be entrained in a relatively high viscosity fracturing fluid are asbestos fibers, shredded cellophane and cellulose fibers.

Since, as contrasted with hydraulic fracturing in oil and gas production, the hydraulic fracturing fluid used in the present invention will usually not be recovered via the infusion hole after fracturing, a wider variety of fracturing fluids can be used, and the principle requirement is that they be capable of being forced through the infusion pipe when developing the required fracture. It should be pointed out, however, that the present invention contemplates the use of one fluid for hydraulically fracturing the coal seam 10 along a plane extending normal to the direction of gas flow in the seam, followed, in some embodiments of the invention, by displacement of this fracturing fluid by a different type of fluid used to fill the fracture and seal the seam against coal migration across the barrier formed by such later injected sealing material. Preferably, the material which is used to establish the final barrier of bloackage to migration of gas should be one which will resist gas intrusion or bypassing of the barrier by forming a semi-solid, plastic mass such as a gel. This type of sealing material is preferred to materials that set up in a rigid, unyielding fashion, such as common cement, since the latter materials may develop cracks permitting passage of the gas therethrough as stresses develop in the coal seam. Also, in the course of fracturing, materials that have a relatively high viscosity during injection are preferred to materials of lower viscosity, since the high viscosity fracturing fluid will generally create a wider fracture, and thereby increase the effectiveness of the seal which is formed by the sealing material in the fracture.

Typical hydraulic fracturing fluids which can be utilized include water based systems, such as aqueous guar gum solutions, hydroxy ethyl cellulose solutions and polyacrylamide solutions, (all of moderate to high viscosity) and oil based systems of moderate to high viscosity, such as emulsions containing one part by weight water, as the external phase, and two parts by weight of hydrocarbon as the internal phase. The described water based systems can contain a delayed cross-linking agent, (such as boric acid derivatives in the case of guar gum solutions), to substantially increase the viscosity of such fracturing fluids. Various hydraulic cements can also be utilized, but are preferably used instead as blocking materials after fracturing has been completed. Cements used for this purpose preferably contain elongated flexible fibers to improve flexural characteristics and reduce cracking. In addition to these hydraulic fracturing fluids, it may be desirable on some occasions to use, only for the purpose of providing a final sealing material in the preformed fracture, a sealing material which is not as well suited for fracturing as the fluid initially employed for that purpose. In such cases, the sealing or blocking material follows and displaces the fracturing fluid into the further reaches of the thereby enlarged fracture. Where the invention is practiced in this way, the viscosity of the sealing fluid is preferably matched with the viscosity of the fracturing fluid to minimize "fingering" and undesirable diffusion. A typical dual system of the type described could utilize an aqueous solution of guar gum (10–100 lbs. of guar gum per 1,000 gallons of water) followed by a polyacrylamide solution containing a cross-linking agent. Fiber-containing cements and silicic acid solutions can also be used as sealing fluids.

Figure 2:
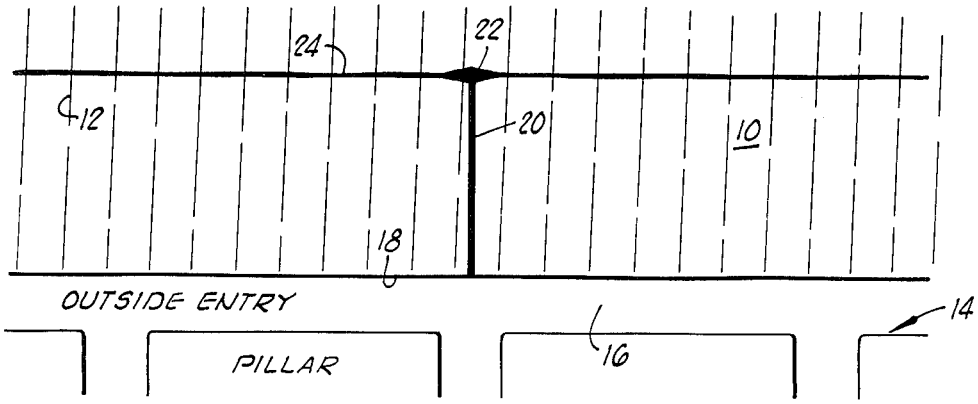
Figure 3:
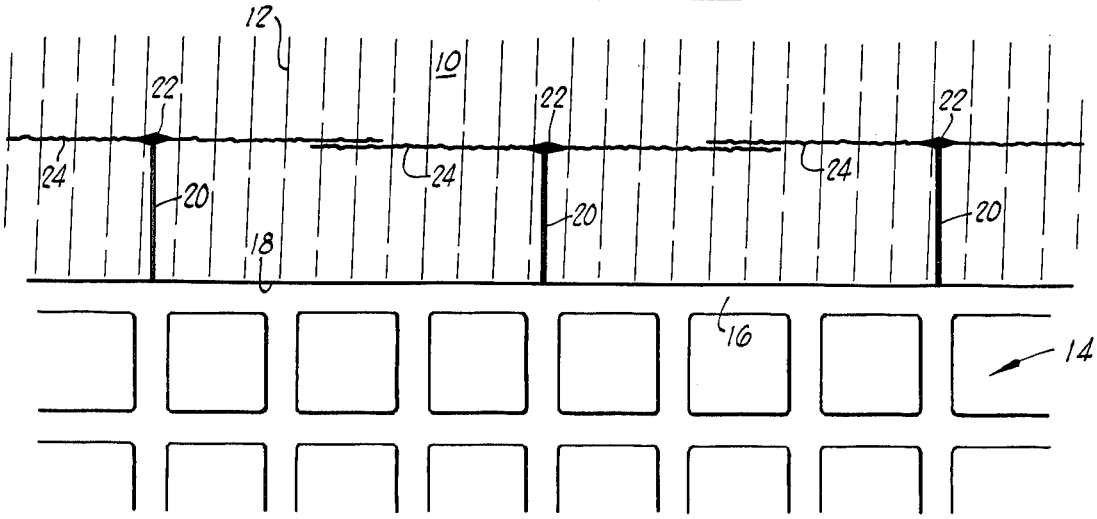

FIG. 2 of the drawing depicts schematically the developed fracture 24 in the coal seam as such fracture is propagated outwardly from the lens-shaped notch 22. It will observed that the fracture 24 extends in a transverse direction with respect to the planes of cleavage 12 in the coal seam 10, and therefore extends substantially normal to the direction of gas flow toward the rib face 18. The distance which the fracture 24 is propagated from the lens-shaped notch 22 can be varied widely. In most instances, however, it is preferred to extend the fracture 24 to the maximum distance obtainable before the fracture alters direction or departs from the desired plane of propagation. Such change of direction of the fracture usually occurs because the fracturing fluid has, in significant quantity, entered one or more of the existing vertical cracks at one of the cleavage planes 12.

After fracturing has been completed by propagation from one of the lens-shaped notches 22 formed at the end of an infusion hole 20, additional infusion holes are drilled in the rib face 18 at locations spaced therealong from the first infusion hole, and in directions substantially parallel to the first infusion hole. The distance that the fracture is propagated outwardly from each lens-shaped notch 22 can typically be about 175 feet in all directions. The spacing of the infusion holes 20 along the rib face should therefore be, in a typical case, about 150 feet, so that an overlap of the fractures is provided to insure integrity of the fluid barrier to gas flow. In instances where a hydraulic fracturing fluid is initially employed for formation of the fractures 24, followed by the use of a sealing or blocking fluid, the fractures will be propagated to a greater distance from the lens-shaped notches 22 as the sealing fluid displaces the fracturing fluid a greater distance, and occupies enough of the fracture to provide the prescribed overlap of those portions of the total fracture which is filled with the sealing or blocking fluid.

In instances where the fluid used for sealing or blocking gas flow is of relatively low viscosity, and has not set up to a gelled or semi-solid state at the time that its placement in the fracture has been completed, the infusion holes are plugged at the opening thereof at the rib face from which they originate, so as to retain the sealing fluid in its operative position within the fracture. In other instances, such blocking or plugging at the openings to the infusion holes 20 will not be required due to the fact that the sealing fluid has set up to a relatively viscous state and will not undergo retrograde flow when the pressure used for injecting it into the fracture is released.

A typical example of the practice of the invention will further aid in its understanding. A coal mine is projected into a seam of bituminous coal averaging about nine feet in thickness and lying at a depth in the earth of 800 feet. The heading of the mine is extended substantially normal to the direction of extension of the planes of cleavage in the seam, and is characterized in having a rib face along one entry of the heading, which rib face is intersected by planes of cleavage spaced about 10 feet apart in the seam.

A plurality of infusion holes are drilled into the seam from the rib face and extend for a distance of 120 feet. Each infusion hole is 4 inches in diameter and is cased with metal pipe having an inside diameter of 3½ inches. The infusion holes formed in the seam from the rib face are on spacings of 150 feet.

At the inner end of each of the infusion holes, a lens-shaped notch having a diameter of 15 inches and a thickness at its center of 3 inches is formed by a mechanical cutting implement extended to the inner end of each infusion hole. After the formation of the infusion holes and lens-shaped notches, an aqueous solution, containing 75 lbs. of guar gum per 1,000 gals. of water, is injected into each of the infusion holes at a pump pressure of 520 psi. Pumping is continued until pressure and volumetric measurements, based on prior empirical determinations, indicate that a fracture has been radially propagated from each of the lens-shaped notches for a distance of 175 feet in the seam, and in a direction generally parallel to the rib face and normal to the planes of cleavage.

On completion of the fracturing, the guar gum solution is displaced into a further extended fracture by the injection of an aqueous solution of a polyacrylamide polymer sold under the trade name Separan by the Dow Chemical Company of Midland, Mich. The viscosity of the polyacrylamide solution is pre-adjusted to match that of the guar gum solution to prevent fingering or undesirable diffusion of the following sealing fluid into the fracturing fluid. The volume of the polyacrylamide solution injected is sufficient to fill the primary fracture extending about 175 feet from each of the lens-shaped notches in a direction parallel to the rib face. After the injection of the polyacrylamide solution, the entrances to the infusion holes are plugged for a period of 8 hours to allow the polyacrylamide to set up to a gas impermeable barrier, which barrier is effective to prevent gas flow to the rib face.

Although certain preferred embodiments of the present invention have been herein described in order to clearly illustrate the basic principles of the invention, it will be understood that various changes in the process conditions can be effected, as well as various other fracturing fluids and sealants employed, without departure from the basic principles and the essential steps used in the process of the invention. Changes and innovations of this type are therefore deemed to be circumscribed by the spirit and scope of the invention except as the same may be necessarily limited by the appended claims or reasonable equivalents thereof.

What is claimed is:

1. In the mining of coal from a seam in which methane gas flow to a mining or rib face is blocked by positioning of a barrier fluid in the seam in the path of gas flow, the improvement comprising:

drilling a plurality of substantially parallel holes into the seam from said face in a direction substantially parallel to the direction of the flow of gas from the interior of said seam;

forming a notch in the coal seam at the interior end of each of the holes;

introducing a hydraulic fracturing fluid under pressure into said notches via said holes;

hydraulically fracturing the coal seam along one or more planes of fracture propagated from each of said notches and extending substantially normal to the direction of gas flow through the coal seam to said face; and stationarily positioning a barrier fluid in said fracture to effectively block the gas flow to said face.

2. The improvement defined in claim 1 wherein each of said notches is configured in a double convex lens-shaped configuration, and said notches each have a diameter of at least 10 inches.

3. The improvement defined in claim 2, wherein the length of said holes is from about 30 feet to about 150 feet.

4. The improvement defined in claim 3 wherein the hydraulic fracturing fluid utilized is an aqueous solution of guar gum.

5. The improvement defined in claim 4 wherein said barrier fluid is stationarily positioned in said fracture by plugging the entrance end of each of said holes.

6. The improvement defined in claim 1 wherein the length of said holes is from about 30 feet to about 150 feet.

7. The improvement defined in claim 1 wherein said barrier fluid is the same fluid as said hydraulic fracturing fluid and is stationarily positioned in said fractures by plugging the entrance end in each of said holes after completion of the hydraulic fracturing.

8. The improvement defined in claim 1 wherein said planes of fracture cross and extend substantially normal to the natural planes of cleavage in the coal seam, and said barrier fluid is predominantly confined to said artificial fractures and predominantly excluded from the natural passageways at the planes of cleavage of the coal.

9. The improvement defined in claim 1 wherein the viscosity of the barrier fluid is matched to the viscosity of the hydraulic fracturing fluid.

10. The improvement defined in claim 1 wherein said barrier fluid is a pumpable material during placement setting up to a semi-solid material yieldable under stress after placement.

11. A method for preventing dangerous emission of methane gas into a coal mine entry from a face of a coal seam comprising:

drilling a hole into a coal seam from said face in a direction substantially parallel to the planes of cleavage in the seam which intersect the face;

forming a lens-shaped notch at the inner end of said hole and projecting radially from said hole generally in a plane extending substantially normal to the longitudinal axis of said hole;

placing a hydraulic fracturing fluid in the hole and notch;

hydraulically fracturing the coal seam along an artificial fracture propagated outwardly from the notch substantially in a plane extending normal to the longitudinal axis of the hole and cutting across a plurality of planes of cleavage; and placing a blocking fluid in the artificial fracture to obstruct the migration of gas to said face through the passageways along said planes of cleavage.

12. The method defined in claim 11 and further characterized as including the steps of:

drilling additional holes in the coal seam from locations spaced along the face from said first hole; and fracturing the coal seam radially outwardly from the inner end of said additional holes to form artificial fractures overlapping said first mentioned artificial fracture whereby said artificial fractures collectively form a barrier fluid reservoir extending across the paths of gas flow along said planes of cleavage.

13. The method defined in claim 11 wherein said hydraulic fracturing fluid is an aqueous polyacrylamide solution.

14. The method defined in claim 11 wherein said lens-shaped notch has a diameter of at least 10 inches.

* * * * *